US011629936B2

(12) United States Patent
Abbe et al.

(10) Patent No.: US 11,629,936 B2
(45) Date of Patent: Apr. 18, 2023

(54) BLAST RESISTANT BARRIER AND CONTAINER

(71) Applicant: American Innovations, Inc., Chestnut Ridge, NY (US)

(72) Inventors: David C. Abbe, Shorewood, MN (US); Donald C. Prim, Jr., La Mesa, CA (US)

(73) Assignee: AMERICAN INNOVATIONS, INC., Chestnut Ridge, NY (US)

( * ) Notice: Subject to any disclaimer, the term of this patent is extended or adjusted under 35 U.S.C. 154(b) by 1430 days.

(21) Appl. No.: 15/232,310

(22) Filed: Aug. 9, 2016

(65) Prior Publication Data

US 2017/0045335 A1 Feb. 16, 2017

Related U.S. Application Data

(60) Provisional application No. 62/203,677, filed on Aug. 11, 2015.

(51) Int. Cl.

| | |
|---|---|
| ***F41H 5/04*** | (2006.01) |
| ***B65F 1/08*** | (2006.01) |
| ***F42D 5/045*** | (2006.01) |
| *B65F 1/14* | (2006.01) |

(52) U.S. Cl.

CPC ..... *F41H 5/0414* (2013.01); *B65F 1/08* (2013.01); *F42D 5/045* (2013.01); *B65F 1/1468* (2013.01); *B65F 2210/13* (2013.01); *B65F 2210/132* (2013.01); *B65F 2220/104* (2013.01); *B65F 2250/112* (2013.01)

(58) Field of Classification Search

CPC .... B65F 1/08; B65F 1/1468; B65F 2250/112; B65F 2220/104; B65F 2210/132; B65F 2210/13; F42D 5/045; F41H 5/0414; B64D 37/32; B65D 90/325; B65D 90/32; B65D 90/22; F42B 39/14; E04B 1/98

USPC ..... 220/88.1, 560.01, 908, 908.1; 206/3

See application file for complete search history.

(56) References Cited

U.S. PATENT DOCUMENTS

| | | | | |
|---|---|---|---|---|
| 3,806,025 | A | 4/1974 | Marshall | |
| 4,989,916 | A | 2/1991 | Powell | |
| 5,013,509 | A | 5/1991 | Kiselewski | |
| 5,158,173 | A * | 10/1992 | Halsey | F42B 39/14 206/3 |
| 5,160,468 | A * | 11/1992 | Halsey | F42B 39/14 206/3 |
| 5,181,619 | A * | 1/1993 | Noble | B07C 7/02 209/702 |
| 5,340,630 | A | 8/1994 | Tripp | |
| 5,500,037 | A | 3/1996 | Alhamad | |
| 5,645,184 | A * | 7/1997 | Rowse | B65D 88/14 220/1.5 |
| RE36,912 | E | 10/2000 | Donovan | |

(Continued)

OTHER PUBLICATIONS

Liu, GF et al. Application of Porous Material. Porous Materials, 2014. (Year: 2014).*

*Primary Examiner* — Robert Poon
*Assistant Examiner* — Onekki P Jolly
(74) *Attorney, Agent, or Firm* — Brian D. Kaul; Westman, Champlin & Koehler, P.A.

(57) ABSTRACT

A blast resistant container includes a rigid outer cylinder, a rigid inner cylinder and at least one pumice brick. The rigid inner cylinder has a longitudinal axis. The at least one pumice brick is within the interior of the rigid inner cylinder.

19 Claims, 6 Drawing Sheets

(56) References Cited

U.S. PATENT DOCUMENTS

| | | | | |
|---|---|---|---|---|
| 6,938,533 | B2 | 9/2005 | Holland et al. | |
| 6,991,124 | B1 * | 1/2006 | Palley | B65D 88/14 220/1.5 |
| 7,281,309 | B2 | 10/2007 | Reynolds | |
| 7,343,843 | B2 | 3/2008 | Sharpe et al. | |
| 8,490,824 | B1 * | 7/2013 | Green, Jr. | B65F 1/06 220/592.2 |
| 2003/0103808 | A1 | 6/2003 | Dolan | |
| 2003/0213802 | A1 * | 11/2003 | Reynolds | B65F 1/02 220/62.15 |
| 2005/0188825 | A1 * | 9/2005 | Sharpe | F42D 5/045 86/50 |
| 2005/0242093 | A1 * | 11/2005 | Sharpe | B65D 90/325 220/62.11 |
| 2006/0027149 | A1 | 2/2006 | Mandall | |
| 2007/0006723 | A1 | 1/2007 | Waddell, Jr. et al. | |
| 2007/0094944 | A1 | 5/2007 | James | |
| 2007/0131684 | A1 * | 6/2007 | Cirillo | F42B 39/14 220/88.1 |
| 2008/0297346 | A1 | 12/2008 | Brackmann et al. | |
| 2009/0019957 | A1 | 1/2009 | Eisenman et al. | |
| 2010/0300275 | A1 * | 12/2010 | Warren | F41H 5/0492 89/36.02 |
| 2011/0023693 | A1 | 2/2011 | Warren et al. | |
| 2012/0167754 | A1 | 7/2012 | Gillis | |
| 2012/0266745 | A1 | 10/2012 | Warren | |
| 2012/0305567 | A1 | 12/2012 | Abbe | |

* cited by examiner

BLAST RESISTANT BARRIER AND CONTAINER

CROSS-REFERENCE TO RELATED APPLICATION

The present application is based on and claims the benefit of U.S. Provisional Application No. 62/203,677 filed Aug. 11, 2015, the content of which is hereby incorporated herein by reference in its entirety.

FIELD

Embodiments of the present disclosure are directed to a blast resistant barrier and container for absorbing, attenuating and/or redirecting the force of an explosion.

BACKGROUND

Waste containers are a necessity in all locations frequented by the public, such as parks, airports, train stations, stadiums and the like. It has long been recognized that such containers can be used by terrorists as hiding places for explosive devices.

The prior art has recognized different approaches to deal with this problem. In Europe, for example, public waste containers consist of relatively small transparent plastic bags suspended from posts and stanchions by thin metal loops, thus making their contents immediately visible to passers-by and security personnel, and tending to dissuade would-be terrorists. A more common but much more expensive approach has been to provide containers intended to withstand and safely absorb and/or harmlessly redirect the force of an explosion from a terrorist device. Such containers are typified by the following:

Holland et al., U.S. Pat. No. 6,938,533 (Sep. 6, 2005) BLAST ATTENUATION CONTAINER, discloses a large domed outer container with access holes for the insertion of waste encloses a smaller open-topped receptacle which slides in and out through a hinged access door in the outer container. The outer container and inner receptacle are lined with a reinforced resin material which is said to be blast-resistant. The resulting device is large, complicated and difficult to construct and put in place.

Reynolds, U.S. Pat. No. 7,281,309 (Oct. 16, 2007) EXPLOSION RESISTANT WASTE CONTAINER discloses a double-layer open-topped steel shell with the inner space filled with poured-in reinforcing material, preferably reinforced concrete. The resulting device is also very heavy and difficult to install and reposition when required.

Sharpe et al., U.S. Pat. No. 7,343,843 (Mar. 18, 2008) EXPLOSIVE EFFECT MITIGATED CONTAINERS AND ENCLOSING DEVICES discloses a can-like container lined with two or more two flexible sheets or belts of inter-connected individual cells or modules, each containing a "shock-attenuating material" such as perlite and a "fusible salt" and "an optional anti-ballistic material".

Waddell Jr., et al., 2007/0006723 (pub. Jan. 11, 2007) ACOUSTIC SHOCK WAVE ATTENUATING ASSEMBLY, like Sharpe et al., discloses bands of flexible armor-like material with encapsulated granular or porous attenuation material (perlite) in discrete modules, flexibly connected to wrap around a threat device enclosed in a container, or to protect an object from an external threat.

Warren, 2012/0266745 (pub. Oct. 25, 2012) APPARATUS FOR PROVIDING PROTECTION FROM BALLISTIC ROUNDS PROJECTILES, FRAGMENTS AND EXPLOSIVES discloses a multi-layer composite ceramic-plastic ballistic armor panel comprising a wire mesh matrix of a core, ceramic layer (spheres or beads), and bonding media (cast urethane), in combination with conventional sheet steel, for trash cans and other applications. See, also Warren et al., 2011/0023693 (pub. Feb. 3, 2011) METHODS AND APPARATUS FOR PROVIDING BALLISTIC PROTECTION.

Eisenman et al., 2009/0019957 (pub. Jan. 22, 2009) METHOD AND SYSTEM FOR DETECTING BOMBS IN TRASH CANS discloses, in a general way, a system for detecting anomalous objects dropped into public area trash cans and transmitting a radio signal to a central watch station.

Holland et al., U.S. Pat. No. 6,938,533 (Sep. 6, 2005) BLAST ATTENUATION CONTAINER discloses a two-element trash can with a domed outer shell containing a smaller inner cylinder, with the cylinder being accessible via a side-opening door. The inner cylinder is to be provided with "blast suppression means" which can include a liquid (though no means of providing and holding the liquid is disclosed or suggested).

Donovan, U.S. Pat. No. Re. 36,912 (Oct. 7, 2000) METHOD AND APPARATUS FOR CONTAINING AND SUPPRESSING EXPLOSIVE DETONATIONS discloses the use of suspended plastic bags containing water for moderating the detonations of an enclosed explosion-hardening process.

SUMMARY

Figure 1:
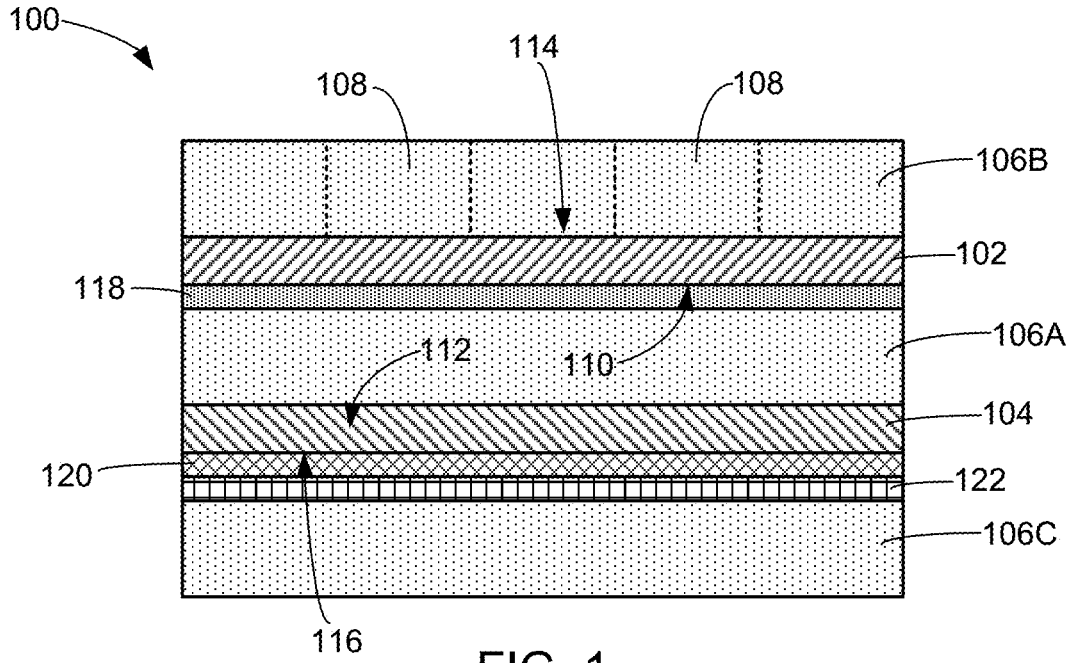
FIG. 1 is a simplified cross-sectional view of a blast resistant barrier, in accordance with embodiments of the present disclosure.

Embodiments of the present disclosure are generally directed to a blast resistant or redirecting container and a blast resistant barrier. Some embodiments of the blast resistant container include a rigid outer cylinder, a rigid inner cylinder and at least one pumice brick. The rigid inner cylinder has a longitudinal axis. The at least one pumice brick is within the interior of the rigid inner cylinder.

Some embodiments of the blast resistant barrier include a rigid inner layer, a rigid outer layer and at least one pumice brick layer formed of compressed pumice. The rigid inner layer and the rigid outer layer include opposing interior surfaces. The at least one pumice brick layer includes at least one pumice brick layer between the interior surfaces of the rigid inner and outer layers, at least one pumice brick layer adjacent an outer surface of the rigid inner layer that is opposite the inner surface of the rigid inner layer, and/or at least one pumice brick layer adjacent an outer surface of the rigid outer layer that is opposite the inner surface of the rigid outer layer.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the invention to those skilled in the art.

Specific details are given in the following description to provide a thorough understanding of the embodiments. However, it is understood by those of ordinary skill in the art that the embodiments may be practiced without these specific details. For example, circuits, systems, networks, processes, frames, supports, connectors, motors, processors, and other components may not be shown, or shown in block diagram form in order to not obscure the embodiments in unnecessary detail.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Some embodiments of the present disclosure are directed to a blast resistant barrier that may be used to absorb, suppress and/or redirect the force of an explosion. The blast resistant barrier may be used to form a container, such as a waste receptacle that may be used to absorb, suppress and/or redirect the force of an explosion resulting from the detonation of an explosive device from within the container.

FIG. 1 is a simplified cross-sectional view of a blast resistant barrier 100, formed in accordance with exemplary embodiments of the present disclosure. Embodiments of the blast resistant barrier 100 include one or more of the layers described herein, which may be organized in a different manner than that described herein without departing from the spirit and scope of the invention.

In some embodiments, the blast resistant barrier 100 includes a rigid inner layer 102, a rigid outer layer 104, and at least one pumice brick layer, generally referred to as 106. In some embodiments, the rigid inner and outer layers 102, 104 are formed of steel. The thickness of the rigid inner and outer layers 102, 104 may be selected as necessary to provide the desired level of blast resistance and structural support. Other suitable materials may also be used for the rigid inner and outer layers 102, 104.

In some embodiments, the at least one pumice brick layer 106 includes a pumice brick layer 106A located between an interior surface 110 of the rigid inner layer 102, and an interior surface 112 of the rigid outer layer 104, as shown in FIG. 1. In some embodiments, the at least one pumice brick layer 106 includes a pumice brick layer 106B adjacent an outer surface 114 of the rigid inner layer 102, and/or a pumice brick layer 106C adjacent an outer surface 116 of the rigid outer layer 104, as shown in FIG. 1.

Each of the at least one pumice brick layers 106 is formed of compressed pumice in the form of one or more pumice bricks, generally referred to as 108, as shown in FIG. 1. The pumice bricks 108 are generally a solid form of perlite or volcanic pumice. That is, rather than being in a powered or granular form, each of the bricks 108 is a solid structure that maintains its solid structure during normal handling. In some embodiments, the pumice bricks 108 are formed by mixing perlite or volcanic pumice with water to form a slurry. The slurry is poured into a mold, and the slurry is compressed within the mold such that the water is extracted. The compressed perlite or volcanic pumice within the mold is dried, such as through a baking process. Once the drying process is completed, the pumice brick is removed from the mold and is ready for use. The mold may be designed as necessary to form the pumice brick 108 in any desired shape, such as the exemplary shapes described below. Alternatively, a pumice brick sheet may be formed using the above-described process. The resultant pumice brick sheet may then be cut and shaped into a desired shape to form a pumice brick 108.

Figure 2A:
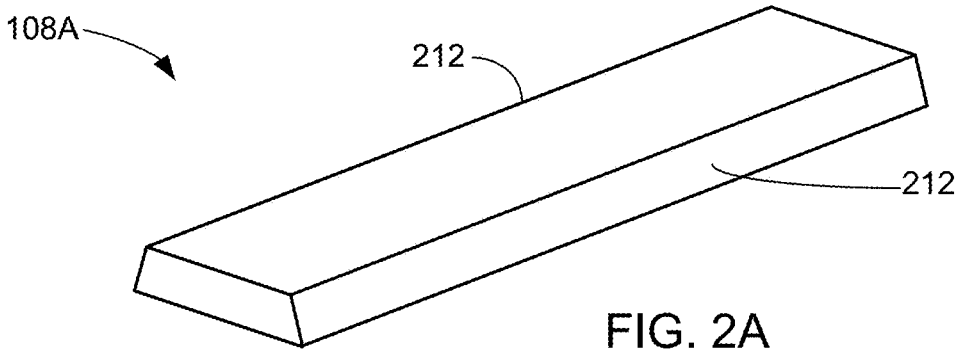
FIG. 2A is an isometric view of an exemplary pumice brick in accordance with embodiments of the present disclosure.
Figure 2B:
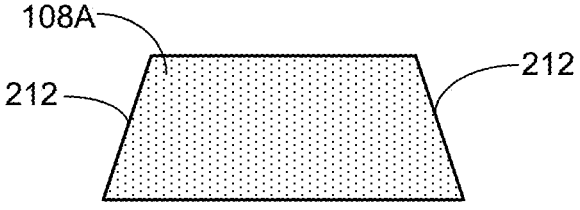
FIGS. 2B and 2C are simplified cross-sectional views of a pumice brick in accordance with exemplary embodiments of the present disclosure.
Figure 2C:
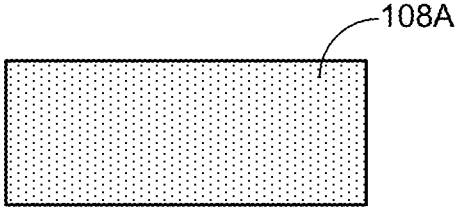

FIG. 2A is a simplified isometric view of an exemplary pumice brick 108A in accordance with embodiments of the present disclosure. In some embodiments, the pumice brick 108 is an elongate member, as shown in FIG. 2A. In some embodiments, the pumice brick 108 may have a cross-sectional shape that is trapezoidal (FIG. 2B), rectangular (FIG. 2C), or other shape.

In some embodiments, the elongate pumice bricks 108A have a thickness of 1-3 inches, a width having a desired dimension, such as greater than 3 inches, and a length having a desired dimension, such as greater than 12 inches, greater than 24 inches, and greater than 36 inches, for example. The pumice brick 108A may be formed in other shapes and sizes as desired or as necessary to provide the desired blast resistance.

Figure 3:
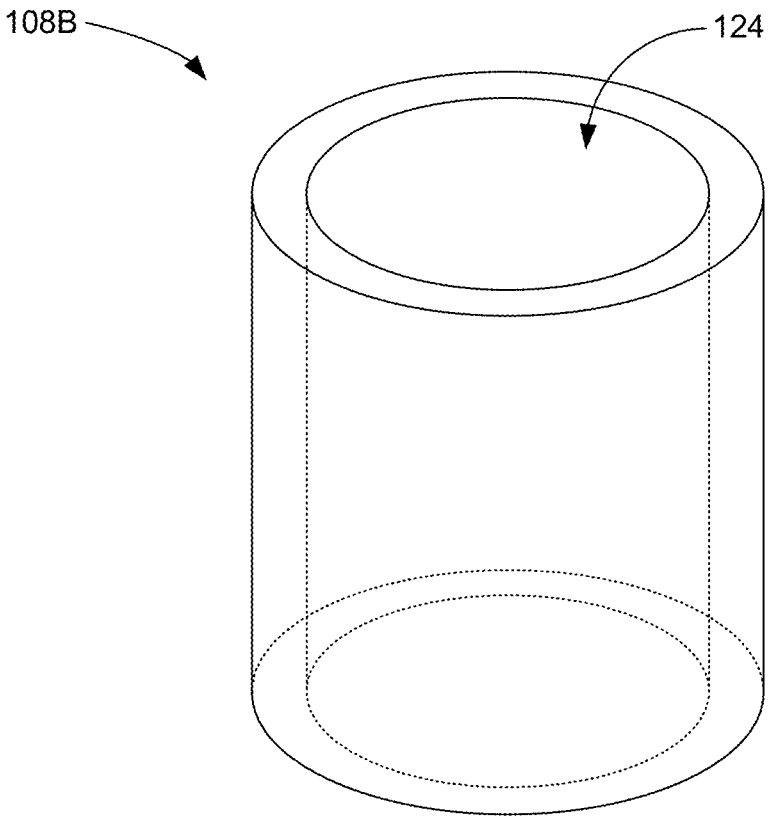
FIG. 3 is an isometric view of a pumice brick cylinder in accordance with embodiments of the present disclosure.

In some embodiments, the pumice brick 108 may be formed as a pumice brick cylinder 108B, as shown in FIG. 3. The pumice brick cylinder 108B defines an interior cavity 124, which may surround a cavity of a container, such as the container described below. In some embodiments, the pumice brick cylinder 108B includes a bottom formed of pumice that is integral with the sides of the pumice brick cylinder 108B.

Figure 4:
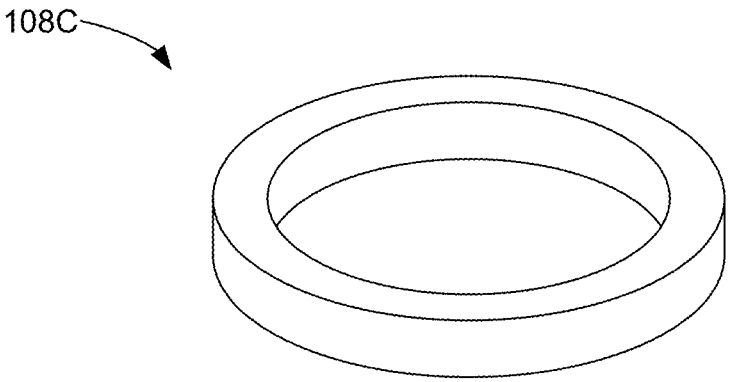
FIG. 4 is an isometric view of an exemplary annular pumice brick in accordance with embodiments of the present disclosure.

In some embodiments, the at least one pumice brick 108 includes at least one annular pumice brick 108C, an exemplary embodiment of which is shown in FIG. 4. Such an annular pumice brick 108C may be stacked as necessary to form a larger cylinder for use in a container, or serve another purpose.

In some embodiments of the blast resistance barrier 100, the rigid inner and outer layers 102, 104 generally conform to the surfaces of the at least one pumice brick 108. Thus, when the at least one pumice brick 108 is in the form of a pumice brick cylinder 108B (FIG. 3) or an annular pumice brick 108C (FIG. 4), the rigid inner and outer layers 102, 104 may also have an annular cross section and, in some embodiments, are generally coaxial to a central axis of the annular bricks 108C or cylindrical bricks 108B.

In some embodiments, the blast resistant barrier 100 includes a compressible material or compressible material layer 118 between the rigid inner layer 102 and the rigid outer layer 104, as shown in FIG. 1. In some embodiments, the compressible material 118 is formed within gaps between the rigid inner and outer layers 102, 104. In some embodiments, the compressible material is formed of rubber, foam, water-filled bladders, or other compressible material. In some embodiments, the compressible material 118 is formed of perlite or volcanic pumice in a powdered or granular form, which is different from the pumice bricks 108.

In some embodiments, the blast resistant barrier 100 includes at least one steel cable reinforced belt or layer 120, as shown in FIG. 1. In some embodiments, the at least one steel cable reinforced belt 120 is located adjacent at least one of the rigid inner layer 102 and the rigid outer layer 104 (FIG. 1). In some embodiments, the at least one steel cable reinforced belt 120 includes at least one steel cable reinforced belt 120 located adjacent the exterior surface 114 of the inner rigid layer 102, or the outer surface 116 of the outer rigid layer 104 (FIG. 1). In some embodiments, the at least one steel cable reinforced belt 120 includes a steel cable reinforced belt 120 located between the rigid inner and outer layers 102, 104. In some embodiments, the steel cable reinforced belt 120 is in the form of a conveyor belt, such as a used conveyor belt, or a tire.

In some embodiments, the blast resistant barrier 100 includes at least one layer of corrugated material 122. In some embodiments, the at least one layer of corrugated material 122 includes corrugated steel. In some embodiments, the at least one layer of corrugated material 122 includes a layer of corrugated material 122 adjacent the outer surface 114 of the inner rigid layer 102, and/or adjacent the outer surface 116 of the rigid outer layer 104 (FIG. 1). In some embodiments, the at least one layer of corrugated material 122 includes a layer of corrugated material 122 located between the rigid inner and outer layers 102, 104.

In operation, the barrier 100 absorbs, attenuates, and/or redirects the force of an explosion. In some embodiments, the pumice brick layer 106 absorbs the blast forces without recoil, which slows the blast wave. The rigid inner and outer layers 102 and 104 also slow the blast pressure wave and resist the blast pressure wave from penetrating through the barrier 100. The slowing of the blast pressure wave by the pumice brick layer 106 and the rigid inner and outer layers 102 and 14, allow the blast pressure wave to be redirected along a surface of the barrier 100, as discussed below in greater detail.

In some embodiments, the barrier 100 includes one or more pumice brick layers 106. In some embodiments, the one or more pumice brick layers 106 are encased or bounded by a metal, plastic, or other material.

Figure 5:
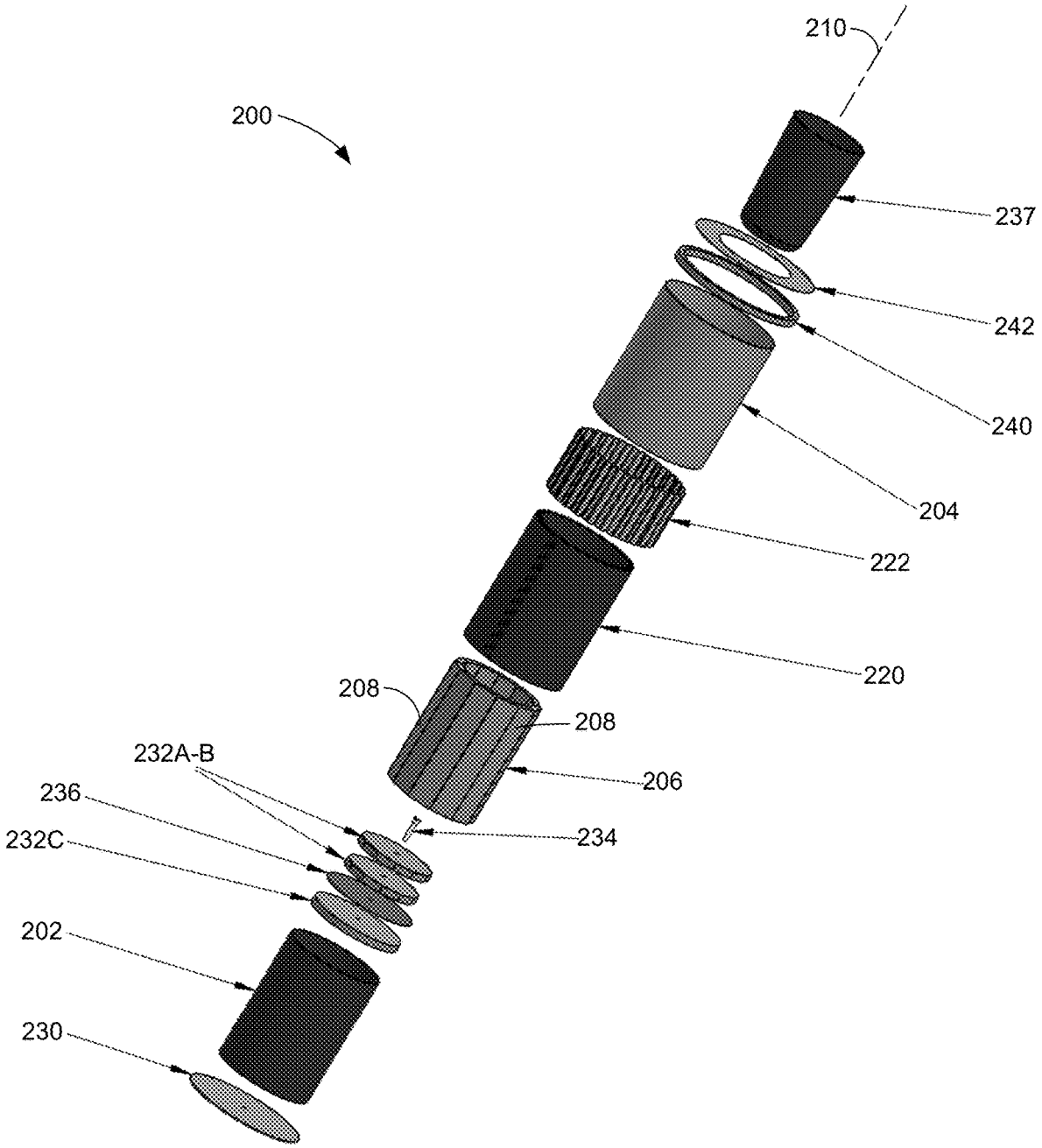
FIG. 5 is an exploded isometric view of a blast resistant or redirecting container in accordance with embodiments of the present disclosure.
Figure 6:
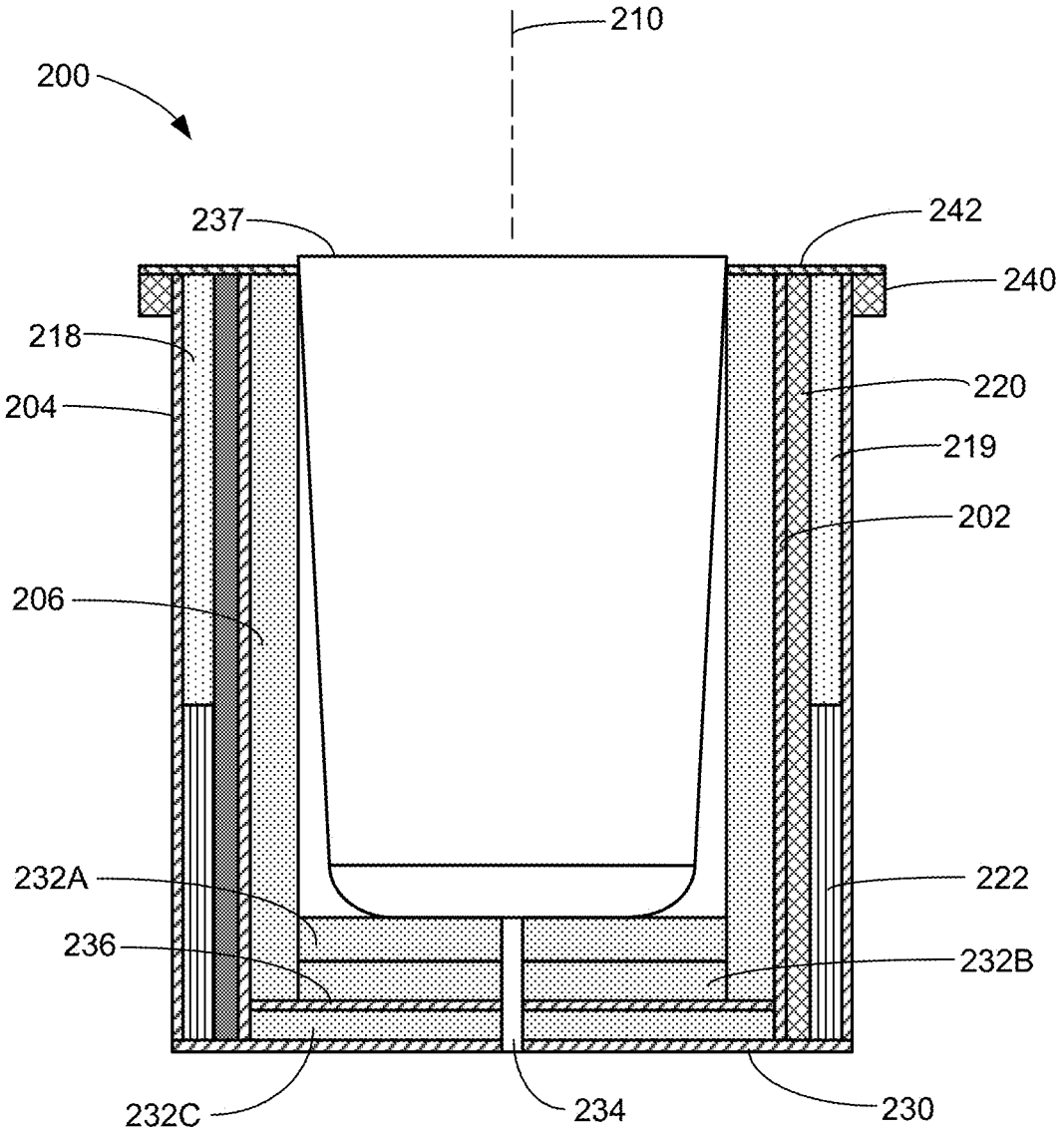
FIG. 6 is a cross-sectional view of a blast resistant or redirecting container in accordance with embodiments of the present disclosure.

Additional embodiments of the present disclosure are directed to a blast resistant or redirecting container 200 that is configured to absorb, attenuate, and/or redirect the force of an explosion from within an interior cavity of the container 200. FIG. 5 is an exploded isometric view of the container 200, in accordance with exemplary embodiments of the present disclosure. FIG. 6 is a simplified cross-sectional view of the container 200 of FIG. 5, in accordance with embodiments of the present disclosure. Additional embodiments and features of the container 200 may be described with reference to the photos of FIGS. 7-13.

In some embodiments, the container 200 generally comprises at least one wall that includes the blast resistant barrier 100 in accordance with one or more embodiments described above.

Figure 9:
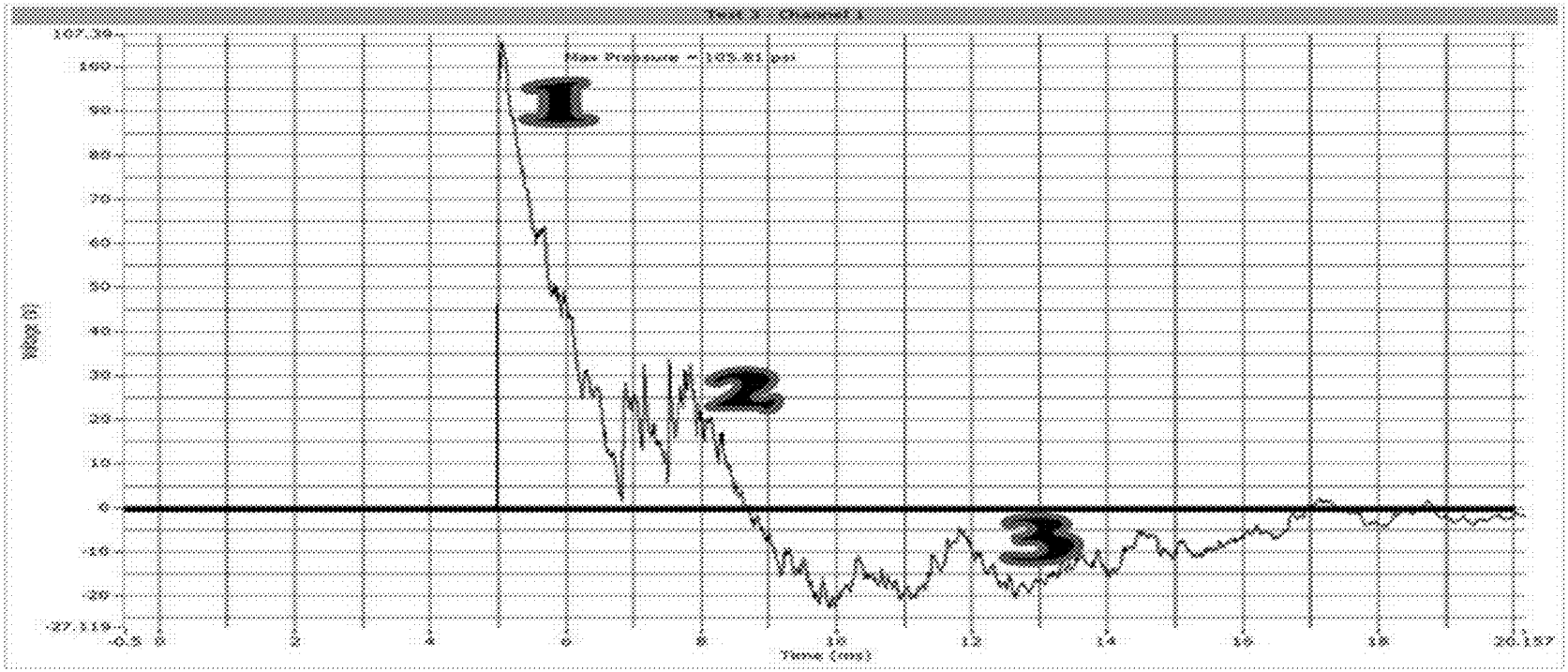
FIG. 9 is a chart illustrating pressures within the blast resistant or redirecting container resulting from the detonation of an exemplary explosive device within the container.

In some embodiments, the container 200 includes a rigid inner cylinder 202, a rigid outer cylinder 204, and a pumice brick layer 206 within an interior cavity of the rigid inner cylinder 202. In some embodiments, the cylinders 202 and 204 are formed of steel. In some embodiments, the rigid inner cylinder 202 has a greater thickness than the rigid outer cylinder 204 as generally shown in FIG. 9. In some embodiments, the rigid inner cylinder 202 and/or the rigid outer cylinder 204 are formed using a trapezoidal or overlapping weld, as shown in FIG. 9.

In some embodiments, the pumice brick layer 206 is formed in accordance with one or more embodiments of the pumice brick layer 106 described above. In some embodiments, the pumice brick layer 206 includes at least one pumice brick 208. The at least one pumice brick 208 may be formed in accordance with one or more embodiments described herein, such as embodiments of the pumice brick 108 described above. In some embodiments, the pumice brick layer 206 comprises a plurality of pumice bricks 208, as shown in FIGS. 5 and 7.

Figure 7:
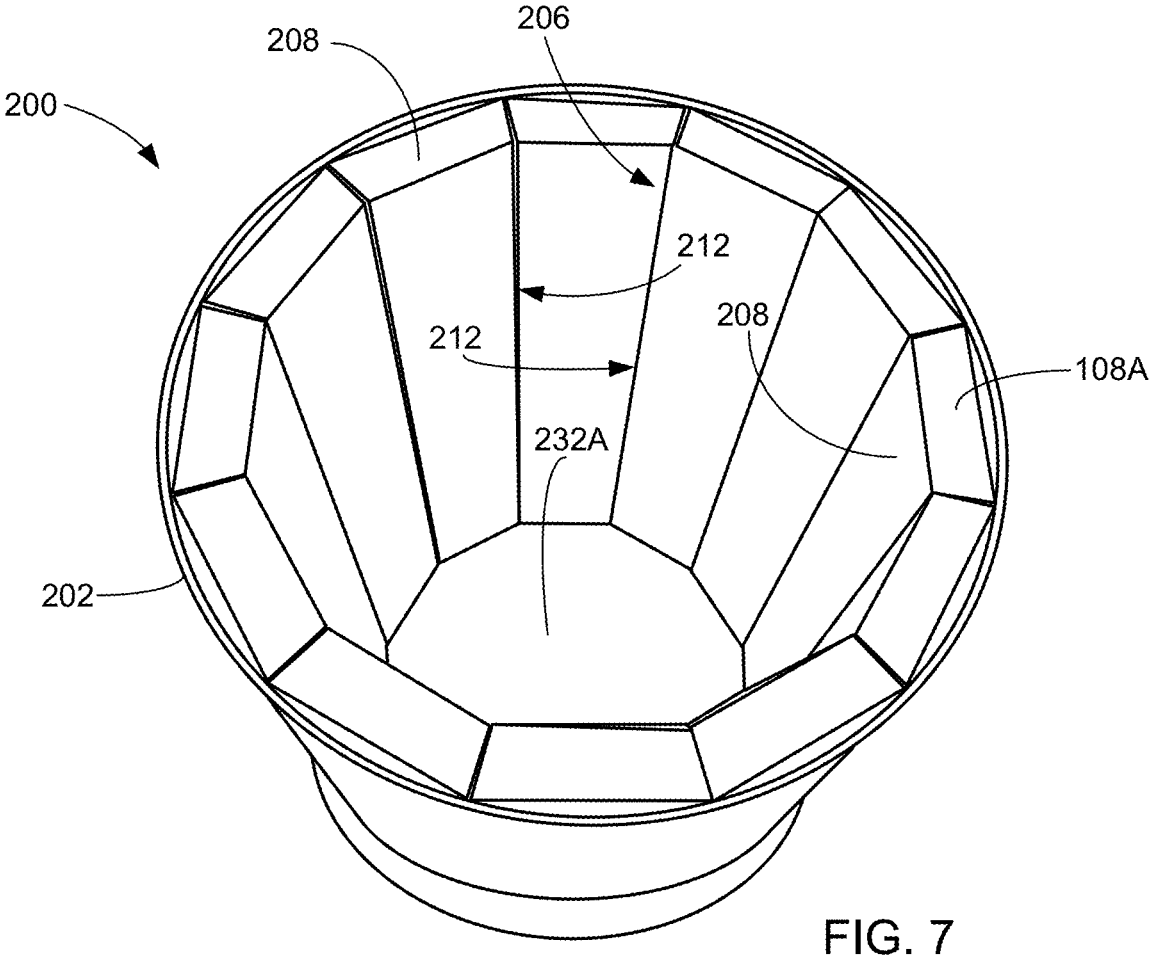
FIG. 7 is a top perspective view of a portion of a blast resistant or redirecting container in accordance with embodiments of the present disclosure.

In some embodiments, the container 200 includes a plurality of the pumice bricks 208 adjacent an inner wall of the rigid inner cylinder 202, as shown in FIGS. 6 and 7. In some embodiments, the at least one pumice brick 208 includes at least one elongate pumice brick 108A (FIGS. 2A-C) having a length that extends along a longitudinal axis 210 of the rigid inner cylinder 202, as shown in FIGS. 5 and 7. In some embodiments, each of the elongated pumice bricks (108A) has a length that is greater than 6 inches, greater than 12 inches, or greater than 24 inches. Other sized pumice bricks 208 may also be used. In some embodiments, the length of each elongated pumice brick 108A is less than 3 feet. In some embodiments, the elongated pumice brick 108 has a width that is greater than 0.5 inches, greater than 1 inch, greater than 2 inches, or greater than 3 inches. In some embodiments, the at least one pumice brick 208 has a thickness of greater than 1 inch, or greater than 2 inches. Additional dimensions of the thickness of the at least one pumice brick 208 may also be used.

In some embodiments, each elongated pumice brick 108A has a trapezoidal cross section (FIG. 2B), a rectangular cross section (FIG. 2C), or other suitable cross-sectional shape. In some embodiments, the trapezoidal cross section of the elongated pumice brick 108A allows the pumice bricks 208 to be stacked adjacent the inner wall of the rigid inner cylinder 202 with minimal gaps formed between the pumice bricks 208, much like the formation of a wooden barrel, as shown in FIG. 7. In some embodiments, the at least one pumice brick 208 forming the pumice brick layer 206 includes more than five elongated pumice bricks 108A, as shown in FIG. 7. In some embodiments, each of the elongated pumice bricks 108A has a longitudinal side 212 (FIGS. 2A-B), that engages a corresponding longitudinal side 212 of an adjacent pumice brick 208, as shown in FIG. 7.

In some embodiments, the container 200 includes a compressible material 218 within a gap 219 between the rigid outer cylinder 204 and the rigid inner cylinder 202, as shown in FIG. 6, and/or within gaps between the at least one pumice brick 208 and the inner wall of the rigid inner cylinder 202. In some embodiments, the compressible material 218 within one or more of these gaps includes powdered or granular pumice, a pumice brick, perlite, rubber, or other compressible material. In some embodiments, the compressible material 218 may include embodiments of the compressible material 118 described above.

In some embodiments, the pumice brick layer 206 comprises a pumice brick cylinder 208, such as the pumice brick cylinder 108B described above with reference to FIG. 3.

In some embodiments, the at least one pumice brick 208 comprises an annular pumice brick, such as the annular pumice brick 108C described above with reference to FIG. 4.

Figure 8:
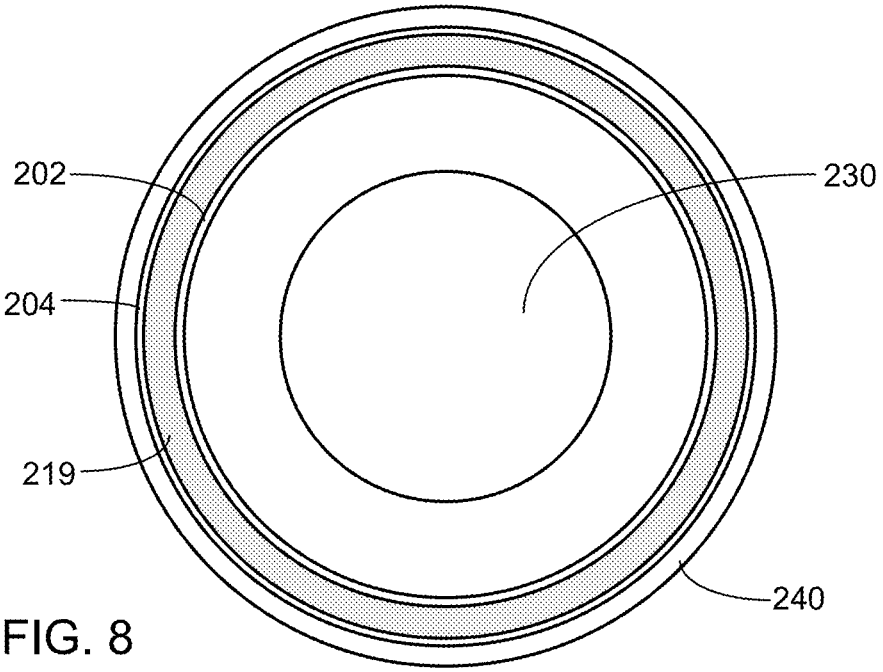
FIG. 8 is a top view of a portion of a blast resistant or redirecting container in accordance with embodiments of the present disclosure.

In some embodiments of the container, the rigid inner cylinder 202 is attached to a rigid base 230, as shown in FIGS. 5, 6 and 8. In some embodiments, the rigid base 230 is formed of steel. In some embodiments of the container 200, at least one pumice brick, generally referred to as 232, covers the base 230, as shown in FIGS. 5, 6 and 7. In some embodiments, the pumice brick 232 is a single structure. In some embodiments, the pumice brick 232 is a pumice brick layer formed by multiple pumice bricks. In some embodiments, the at least one pumice brick 232 are in the form of circular pumice bricks. In some embodiments, the container 200 includes a pumice brick 232A, a pumice brick 232B, and/or a pumice brick 232C, as shown in FIG. 5. In some embodiments, at least one of the pumice bricks 232, such as pumice brick 232A, is formed integrally with the pumice brick layer 206 in the form of a cylindrical pumice brick (108B).

In some embodiments, the container 200 includes a drain tube 234 extending through the at least one pumice brick 232 and the rigid base 230, as shown in FIG. 6. The drain tube 234 allows fluid within the container 200 to drain.

In some embodiments, the container 200 includes a crush panel 236 that is located over or under the at least one pumice brick 232. For instance, a pumice brick 232A and/or 232B may be positioned on a top side of the crush panel 236 and a pumice brick 232C may be positioned below the crush panel 236, as illustrated in FIGS. 5 and 6. In some embodiments, the crush panel 236 is formed of steel. In some embodiments, the drain tube 234 extends through the crush panel 236, as shown in FIG. 6. In some embodiments, the at least one pumice brick 232 and the crush panel 236 cancels the Mach Stemming effect within the container 200. In some embodiments, the pumice bricks 232A and/or 232B generally conform to an interior diameter of the inner rigid cylinder 202 or the pumice brick layer 206.

In some embodiments, the container 200 includes a trash receptacle 237 within an interior volume defined by the at least one pumice brick 208 or the pumice brick layer 206, as shown in FIGS. 5 and 6. In some embodiments, the trash receptacle 237 includes an open interior volume for receiving trash or other material. The container 200 is designed to absorb, attenuate, and/or redirect the force of an explosion from within the interior of the trash receptacle 237, such that the blast does not extend horizontally from the container 200 in a manner that may injure people near the container 200. In some embodiments, the majority of the blast force is redirected out through the top of the container 237 in a manner that is less likely to injure people surrounding the container 200. In some embodiments, the drain tube 234 extends into the trash receptacle 237, and allows fluid within the trash receptacle 237 to drain.

In some embodiments, the container 200 includes at least one steel cable wrapped around the inner rigid cylinder 202. In some embodiments, the at least one steel cable is in the form of a steel cable reinforced belt 220, as shown in FIGS. 5 and 6. In some embodiments, the steel cable reinforced belt 220 extends around the inner rigid cylinder 202, as shown in FIG. 6. In some embodiments, the steel cable reinforced belt 220 is wrapped around the rigid inner cylinder 202, at least two times. In some embodiments, the steel cable reinforced belt 220 is in the form of a conveyor belt, such as a used conveyer belt. In some embodiments, the conveyer belt meets the requirements of the standard ST1250. In some embodiments, the steel cable reinforced belt 220 is capable of withstanding 100,000 pound per linear inch. In some embodiments, the steel cable reinforced belt 220 is configured to resist expansion of the rigid inner cylinder 202 to blast pressure from within the interior of the cylinder 202 due to a detonation of an explosive device within the container 200.

In some embodiments, the container 200 includes a corrugated cylinder 222 surrounding at least a portion of the rigid inner cylinder 202, as shown in FIGS. 5 and 6. In some embodiments, the corrugated cylinder 222 extends along the majority of the length of the rigid inner cylinder 202 (i.e., along the longitudinal axis 210). In some embodiments, the corrugated cylinder 222 only extends along a portion of the length of the rigid inner cylinder 202, as shown in FIG. 6. In some embodiments, the corrugated cylinder 222 covers only a bottom portion of the rigid inner cylinder 202, as shown in FIG. 6. The corrugated cylinder 222 operates to further resist the expansion of the inner cylinder 202 responsive to an explosion within the inner rigid cylinder 202. It is preferable that at least the bottom portion of the rigid inner cylinder 202 be surrounded by the corrugated cylinder 222, as the highest blast pressures are likely to occur at the bottom of the rigid inner cylinder 202 due to an explosive device placed in the container 200. In some embodiments, the corrugated cylinder 222 is formed of steel.

In some embodiments, the container 200 includes a lift ring 240 that is preferably welded to the outer rigid cylinder 204, as shown in FIGS. 5 and 6. The lift ring 240 assists in the prevention of expansion failure at the top of the container 200. Additionally, the lift ring 240 may be used to allow a fork lift or other machinery to carry the container 200.

In some embodiments, the container 200 includes a top ring 242 that generally extends from the lift ring 240 to the rigid inner cylinder 202, as shown in FIGS. 5 and 6. The ring 242 encloses the material between the rigid inner cylinder 202 and the rigid outer cylinder 204.

In some embodiments, a conventional trash receptacle cover may be positioned over the ring 242 and the opening to the trash receptacle 237, as shown in FIG. 13 to configure the container 200 as a waste receptacle.

In some embodiments, the container 200 is configured to block the horizontal blast pressure from an explosion within the container 200 from injuring bystanders surrounding the container 200. In some embodiments, the container 200 redirects the majority of the force of the explosive blast vertically through the top of the container 200. FIG. 9 illustrates the three phases of explosive pressures within the container 200 due to the detonation of an explosive device within the container 200. In a first phase, an extremely short (less than 0.0005 seconds) high shock occurs, followed by a longer duration (approximately 0.002 seconds) high pressure expansion in the second phase, followed by a decompression wave in the third phase, of the returning gasses that are displaced by the rapid expansion of the first two high pressure waves, as shown in FIG. 9.

The first phase of the explosion generates a high velocity shockwave and fire front, that can expand at hypersonic (20,000 feet per second plus) speed. The pumice brick layer 206 of the container 200 absorbs, but does not recoil these shockwaves and serves to reduce the expansion rate of the shockwave, and begins the redirection of the pressure to exhaust the shockwave vertically from the top of the container 200.

After the one or more pumice bricks 208 of the pumice brick layer 206 are reduced to powder by the initial shockwave, they immediately mix with the secondary fireball that is propagating out of the top of the container 200. Without the mixing of the pumice powder the secondary fireball will extend through the top of the container 200. The harmless pumice powder adds an invaluable secondary function of suppressing the fireball resulting from the main ignition of explosive chemicals, thereby greatly reducing collateral fire damage.

The rigid inner cylinder 202 and the rigid outer cylinder 204 assist in the control of the expanding blast gasses that have already been mitigated by the pumice bricks 208 of the pumice brick layer 206. This allows the rigid inner cylinder 202 to resist, for a short period, the already slower, lower expanding gasses, which force the rigid inner cylinder 202 outward into the steel cable reinforced belt 220. For the next millisecond or so, the pressure builds up, stretching the rigid inner cylinder 202 and the steel cable reinforced belt 220 to a catenary maximum. As these parts are reaching that expansion point they engage a thick layer of compressible material 218, such as powder or granular volcanic pumice or perlite that is reinforced by the corrugated steel cylinder 222 where the highest radial forces are generated. The compressible material 218 and the corrugated cylinder 222 absorb more of the reduced but high expansion forces adding up to another millisecond to the time before the container 200 reaches its burst point.

By the time the expanding explosive gasses have forced their way through all four walls of blast containment (the pumice brick layer 206, the rigid inner cylinder 202, the steel belt reinforced cable 220, and the compressible layer 218), the container 200 has increased the time for those expanding gasses to follow the path of least resistance up and out of the top of the container 200. Also by the design of the container 200, the expansion of the inner chamber of the container 200 can cause the container 200 to form a rocket like nozzle system which further focuses those gasses in a vertical column for such a height as to greatly reduce the possibility of damaging nearby bystanders or structures. The container 200 is, of course, permanently damaged and generally rendered unusable, except for prosecutorial evidence in the pending cases against the perpetrators of the event.

Although the present invention has been described with reference to preferred embodiments, workers skilled in the art will recognize that changes may be made in form and detail without departing from the spirit and scope of the invention.

What is claimed is:

1. A blast resistant or redirecting container comprising:
- a rigid outer cylinder;
- a rigid inner cylinder within the rigid outer cylinder and having a longitudinal axis; and
- a plurality of pumice bricks within the interior of the rigid inner cylinder,
- wherein:
  - each of the pumice bricks comprises pumice that is compressed into a brick form having a solid structure; and
  - the plurality of pumice bricks includes a group of pumice bricks that are displaced around the longitudinal axis adjacent an inner wall of the rigid inner cylinder.

2. The container according to claim 1, wherein the group of pumice bricks includes a plurality of elongated pumice bricks each having a length extending along the longitudinal axis that is greater than its width.

3. The container according to claim 2, wherein:
- the length of each elongated pumice brick is selected from the group consisting of greater than 6 inches, greater than 12 inches, greater than 2 feet, and less than 3 feet;
- a width of each elongated pumice brick selected from the group consisting of greater than 0.5 inches, greater than 1 inch, greater than 2 inches, and greater than 3 inches; and
- a thickness of each elongated pumice brick is selected from the group consisting of greater than 1 inch and greater than 2 inches.

4. The container according to claim 2, wherein each elongated pumice brick has a trapezoidal cross section.

5. The container according to claim 2, wherein each elongated pumice brick includes a longitudinal side that contacts a longitudinal side of an adjacent elongated pumice brick.

6. The container according to claim 1, wherein the plurality of pumice bricks comprises at least one of a pumice brick cylinder and an annular pumice brick.

7. The container according to claim 1, wherein:
- the rigid inner cylinder is attached to a rigid base; and
- the plurality of pumice bricks includes at least one base pumice brick covering the base within the interior of the inner rigid cylinder.

8. The container according to claim 7, further comprising a drain tube extending through the at least one base pumice brick and the rigid base.

9. The container according to claim 7, further comprising a crush panel over or under the at least one base pumice brick.

10. The container according to claim 9, wherein the at least one base pumice brick comprises first and second base pumice bricks, and the crush panel is between the first and second base pumice bricks.

11. The container according to claim 10, further comprising a compressible material within a gap between the rigid outer cylinder and the rigid inner cylinder, wherein the compressible material includes at least one of powdered or granular pumice, a pumice brick, perlite, and rubber.

12. The container according to claim 9, further comprising a steel cable reinforced belt wrapped around the inner rigid cylinder.

13. The container according to claim 12, further comprising a corrugated cylinder surrounding at least a portion of the rigid inner cylinder.

14. The container of claim 1, wherein each pumice brick in the group of pumice bricks contacts an adjacent pumice brick within the group.

15. A blast resistant barrier comprising:

a rigid inner layer;

a rigid outer layer; and at least one pumice brick layer formed of pumice that is compressed into a brick form having a solid structure, wherein:

the rigid inner layer and the rigid outer layer include opposing interior surfaces; and the at least one pumice brick layer includes at least one pumice brick layer selected from the group consisting of a pumice brick layer between the interior surfaces of the rigid inner and outer layers, a pumice brick layer adjacent an outer surface of the rigid inner layer that is opposite the inner surface of the rigid inner layer, and a pumice brick layer adjacent an outer surface of the rigid outer layer that is opposite the inner surface of the rigid outer layer.

16. The barrier according to claim 15, wherein the pumice brick layer comprises a plurality of elongate pumice bricks.

17. The barrier according to claim 15, further comprising at least one steel cable reinforced belt adjacent at least one of the rigid inner layer and the rigid outer layer, or between the rigid inner and outer layers.

18. The barrier according to claim 17, further comprising at least one layer of corrugated material adjacent at least one of the rigid inner layer and the rigid outer layer, or between the rigid inner and outer layers.

19. The barrier according claim 18, wherein the rigid inner and outer layers are formed of steel.

* * * * *